US005608286A

United States Patent [19]

Levine et al.

[11] Patent Number: 5,608,286

[45] Date of Patent: Mar. 4, 1997

[54] AMBIENT LIGHT ABSORBING FACE PLATE FOR FLAT PANEL DISPLAY

[75] Inventors: Jules D. Levine, Dallas; Chi-Cheong Shen, Richardson; Bruce E. Gnade, Dallas, all of Tex.

[73] Assignee: Texas Instruments Incorporated, Dallas, Tex.

[21] Appl. No.: 347,011

[22] Filed: Nov. 30, 1994

[51] Int. Cl.[6] ..... H01J 1/62

[52] U.S. Cl. ..... 313/495; 313/461; 313/463; 313/496

[58] Field of Search ..... 313/461, 462, 313/463, 464, 465, 466, 473, 474, 495, 496

[56] References Cited

U.S. PATENT DOCUMENTS

| | | | |
|---|---|---|---|
| 2,705,765 | 4/1955 | Geer | 313/461 |
| 4,726,662 | 2/1988 | Cromack | 350/345 |
| 4,857,799 | 8/1989 | Spindt et al. | 313/495 |
| 4,972,117 | 11/1990 | Adler et al. | 313/478 |
| 5,061,050 | 10/1991 | Ogura | 359/490 |
| 5,103,144 | 4/1992 | Dunham | 315/366 |
| 5,192,472 | 3/1993 | Kurematsu et al. | 359/619 |
| 5,206,746 | 4/1993 | Ooi et al. | 359/40 |
| 5,210,641 | 5/1993 | Lewis | 359/448 |
| 5,225,820 | 7/1993 | Clerc | 340/752 |
| 5,240,748 | 8/1993 | Van Eskonk et al. | 427/554 |
| 5,272,410 | 12/1993 | Fox | 313/113 |
| 5,491,376 | 2/1996 | Levine et al. | 313/461 |

OTHER PUBLICATIONS

Zaidi, Saleem H. and Brueck, S. R. J.; *Multiple Exposure Interferometric Lithography,* SPIE 2197; Optical/Laser Microlithography VII, pp. 869–875 (1994).

Cowan, James J., *Holographic Honeycomb Microlens,* Optical Engineering, pp. 769–802, Sep./Oct. 1985, vol. 24, No. 5.

*Primary Examiner*—Sandra L. O'Shea
*Assistant Examiner*—Vip Patel
*Attorney, Agent, or Firm*—Warren L. Franz; Wade James Brady, III; Richard L. Donaldson

[57] ABSTRACT

A computer image display device includes a light transparent glass anode plate (10) spaced from a cathode substrate (12) which has a plurality of microtips (14). Plate (10) has an inside surface (25) which is contoured with an array of prisms (36) having equal sides (58, 59) that converge rearwardly toward apexes (38) of peaks (36). Apexes (38) are covered with light absorbing material (47), then covered at anode comb forming regions (51, 52, 53) with conductive material (48). Different color luminescing phosphors (24*a*, 24*b*, 24*c*) are applied over the respective anode combs (51, 52, 53). Sides (58, 59) direct ambient light toward apexes (38) for absorption by material (47). Light emitted by phosphors (24*a*, 24*b*, 24*c*) is directed by valleys (60) toward outside surface (35) of plate (10).

19 Claims, 4 Drawing Sheets

AMBIENT LIGHT ABSORBING FACE PLATE FOR FLAT PANEL DISPLAY

This invention relates generally to image display devices and, in particular, to image display devices of the flat panel display type which have transparent face plates including electrodes and cathodoluminescent coatings.

BACKGROUND OF THE INVENTION

Image display devices, such as flat panel display devices, are subject to contrast ratio reduction and glare due to reflections of ambient light at transparent face plates and underlying cathodoluminescent coatings. Various structures and treatments have been used to address this problem, including the provision of surface irregularities and patterns, to function as ambient light scattering elements that redirect reflections of incident ambient light away from the angle of view of the viewer. Examples of such treatments are given in U.S. Pat. Nos. 4,972,117 and 5,240,748. For liquid crystal displays (LCDs), available viewer viewing angles tend to be limited, so scattering of glare causing reflections out of the field of view has some use; though, the trend is to increase available viewer angles. Moreover, though scattering reduces reflection concentrations at any given angle of reflection, non-productive light (i.e., light that is not part of the image-formative process) is still returned to the viewer.

U.S. Pat. No. 5,206,746 discloses a transparent optical device comprising a side-by-side array of triangular prisms that is interposed between spaced liquid crystal and backlighting components of a liquid crystal display. The prism bases serve as apertures for admission of incident ambient light into channels bounded by converging prism side surfaces. The prism apexes (called "valley bottom portions" in the '746 patent) are covered with light absorbing material. Ambient light incident on the bases of the prisms is multiply reflected toward the apexes and absorbed by the absorbing material. On the other hand, light traveling in the opposite direction from the backlighting source and incident on the apexes is relatively unaffected and enabled to pass through to the viewer, or be scattered, in accordance with the transparent or scattering mode imparted to the liquid crystals. The full disclosure of the '746 patent is incorporated herein by reference.

The '746 prisms are formed by machining, casting, pressing, injection molding or similar processes for which sharp peaks are not obtained. A trade-off is, therefore, required between sizing and covering truncations or "cuts" with material for maximum ambient light absorption, and minimizing obstruction to transmission of image-forming backlighting in the other direction. Moreover, the size and pitch of the '746 prisms is on the order of millimeters; thus, careful positioning is required to avoid blocking pixel rows/columns or introducing moire interference patterns ( see, e.g., discussion in the '117 patent).

Flat panel displays are widely used as image display screens for laptop and notebook computers. In this context, the term "flat" used herein is a reference to thinness (viz. compared to traditional electron gun cathode ray tube displays), not planarity. That term is therefore intended to encompass thin non-planar, curved displays, as well as thin planar displays. Flat panel displays of the so-called "field emission display" (FED) type, such as described in U.S. Pat. Nos. 4,857,799, 5,103,144 and 5,225,820, have transparent face plates including anode electrodes and cathodoluminescent coatings. Such displays include a matrix array of individually addressable light generating means. An emitter plate, spaced from the face plate, has a plurality of conductive stripes, each with a multiplicity of spaced-apart electron emitting tips which serve as cathodes and project upwardly toward the face plate. An electrically conductive extraction (i.e. gate) electrode arrangement is positioned on the emitter plate adjacent the tips to generate and control the electron emission. The extraction electrode arrangement comprises a large number of individually addressable, cross-stripes which are orthogonal to the cathode stripes and which include apertures through which emitted electrons may pass.

Because it is desired to be able to operate them at low power and under bright outdoor light, FED displays are especially sensitive to the problem of ambient light reflection. The cathodoluminescent coating used most often on FED displays is a layer of granular phosphor. While only as little as 3% of incident ambient light may reflect back from the glass-air boundaries of the plate, as much as 50% may be reflected by the phosphor layer. This severely restricts the contrast ratio available even in an undarkened room. In fact, under normal outdoor or room lighting conditions, the unlit ("off" condition) conventional FED screen appears white, rather than gray or black.

The anode of a conventional FED display comprises a thin film of electrically conductive material which covers the interior surface of the face plate. For a monochrome display, the anode film usually takes the form of a continuous layer across the surface of the face plate. For a color display, as in U.S. Pat. No. 5,225,820, the anode is segmented into three electrically isolated combs. Each comb comprises a plurality of connected bands or stripes covered with phosphor particles which luminesce in a different respective one of the three primary colors—red, blue and green. Because of the reflective nature of metal, and in order to be able to view the luminescing phosphor through the anode, conventional FED designs require that the anode be formed of a transparent conductive material, such as indium-tin-oxide (ITO). Such transparent material is, however, less conductive than aluminum and other traditional non-transparent conductive materials.

Arcing between different color phosphor anode stripes is minimized in FED displays by drawing and maintaining a vacuum in the space between anode and emitter plates. However, voltage standoff between different color combs at high voltages is still a problem because of surface leakage between coplanar razor edges of the separate electrode depositions disposed across the smooth back surface of the shared face plate. Such leakage is a precursor to arcing. There is, thus, also a need to minimize leakage between adjacent stripes of different color combs.

SUMMARY OF THE INVENTION

The invention provides a transparent face plate for an image display device, the face plate being dimensioned, configured and adapted for reducing reflections of ambient light incident thereon.

The invention further provides a flat panel display device having a transparent face plate including an electrode and cathodoluminescent material, which is dimensioned and configured to have reduced incident ambient light reflectivity and increased interelectrode arc protection.

In accordance with one aspect of the invention, an anode plate of an image display device is provided with a surface comprising a grating formed by a side-by-side array of prisms. The array acts as a unidirectional optical filter to block reflections of ambient light incident thereon, without unduly interfering with passage in an opposite direction of image-formative light. In a preferred embodiment, discussed in greater detail below, an array of prisms is produced in micron-order pitch, with saw-toothed cross-sectional configuration and light absorbing material covering apexes of sharpened peaks.

A conductive material is deposited on the apexes of the prisms to provide an electrode. Cathodoluminescent material, such as a phosphor particulate coating, is deposited over the electrode. A preferred embodiment of transparent face plate, suitable for use in an FED flat panel display, has a plurality of electrodes formed on adjacent regions of the saw-toothed surface and coated with different color emissive phosphor particles.

A transparent face plate and display device formed in accordance with the invention serves simultaneously to improve image contrast ratio and to improve voltage standoff between adjacent electrodes. The sharpened peak, micron-order pattern provides preferential directional light transmission, with reduced image obstruction and minimal pattern/pixel alignment or moire interference concerns. The saw-toothed configuration directs incident ambient light down converging channels for absorption at the peaks, keeping it away from the reflective phosphor layer. Light emitted by the phosphor, on the other hand, is not blocked by the absorber but travels unimpeded (and, in fact, preferentially directed) toward the viewer, thereby enhancing image contrast even beyond simple removal of reflections. Forming the electrodes over the peak tips, increases the path for surface conduction between adjacent electrode stripes, thereby increasing arc avoidance and enabling higher voltages to be used.

BRIEF DESCRIPTION OF THE DRAWINGS

Embodiments of the invention have been chosen for purposes of illustration and description, and are shown with reference to the accompanying drawings, wherein.

Throughout the drawings, like elements are referred to by like numerals.

DETAILED DESCRIPTION OF THE PREFERRED EMBODIMENTS

Figure 1:
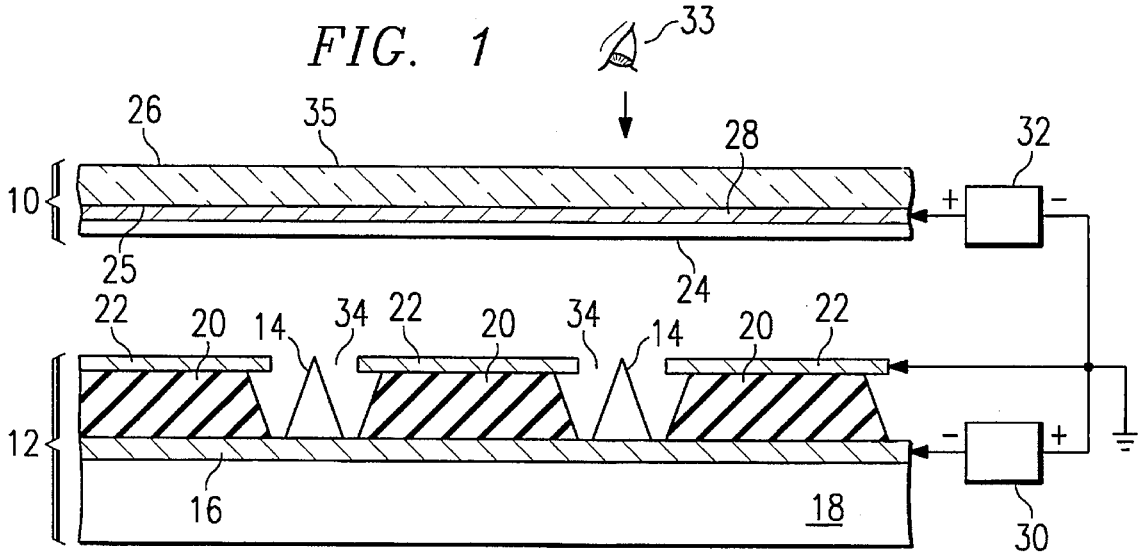
FIG. 1 is a cross-sectional view of a conventional field emission display (FED) device of the type to which the present invention finds particular application.

A flat panel display device in accordance with the invention comprises a cathodoluminescent anode face plate 10, spaced apart in known way across a vacuum gap from an electron emitter (or cathode) backing plate 12. Emitter plate 12 comprises a cathode electrode having a multiplicity of electrically conductive microtips 14 formed on an electrically conductive layer 16 of stripes formed on an upper surface of an electrically insulating substrate 18.

An extraction (or gate) electrode 22 comprises an electrically conductive layer of cross-stripes deposited on an insulating layer 20 which serves to insulate electrode 22 and space it from the conductive layer 16. Microtips 14 are in the shape of cones which are formed within apertures through conductive layer 22 and insulating layer 20. The relative parameters of microtips 14, insulating layer 20 and conductive layer 22 are chosen to place the apex of each microtip 14 generally at the level of layer 22.

Anode plate 10 comprises an electrically conductive layer of material 28 deposited on a transparent (viz. glass) substrate 26, which is positioned facing extraction electrode 22 and parallel thereto. The conductive layer 28 is deposited on an inside surface 25 of substrate 26, directly facing gate electrode 22. Conductive layer 28 may be in the form of a continuous single electrode deposited over the surface 25 of substrate 26; or, alternatively, may be in the form of a plurality of electrically isolated electrode combs. Each comb comprises a plurality of connected parallel conductive bands or stripes deposited in interdigitated positions over the surface 25 of substrate 26. By way of example, conductive layer 28 may be a transparent material, such as indium-tin-oxide (ITO) as taught in U.S. Pat. No. 5,225,820; or, in accordance with the principles of this invention, it may be any transparent or non-transparent conductive material, as more fully described below. Anode plate 10 also comprises a phosphor coating 24, deposited over the conductive layer 28, so as to be directly facing and immediately adjacent extraction electrode 22. The phosphor coating 24 may be applied to conductive layer 28 using an electrophoretic deposition or other known process.

In accordance with conventional teachings, one or more of the microtip emitters 14 can be energized by applying a negative potential to layer 16 relative to the extraction electrode 22, via a voltage supply 30, thereby inducing an electric field which draws electrons from the microtips 14. The freed electrons are accelerated toward the anode plate 10 which is positively biased by the application of a substantially larger positive voltage from a voltage supply 32 coupled between the extraction electrode 22 and conductive layer 28. Energy from the electrons emitted by the cathode electrode 16 and attracted to the anode electrode 28 is transferred to particles of the phosphor coating 24, resulting in luminescence. Electron charge is transferred from phosphor coating 24 to conductive layer 28, completing the electrical circuit to voltage supply 32. Also in accordance with known techniques, stripes of cathode layer 16 and gate layer 22 can be individually matrix-addressed to provide selective pixel illumination of corresponding phosphor areas, to develop an image viewable to a viewer 33 looking at the front or outside surface 35 of the plate 10.

All the electronic circuitry of the display, including the voltage supplies, may be integrated into the emitter plate 12, with the exception of the conductor 28 comprising the anode electrode, which is included in the anode plate 10. In the case of a single conductive electrode 28 spread across the surface 25 of support 26, one electrical connection is required between the emitter plate 12 and the anode plate 10. Where, however, the anode comprises three electrodes in the form of electrically isolated combs, as taught in the '820 patent, three electrical connections are required between the emitter plate 12 and the anode plate 10.

Figure 2:
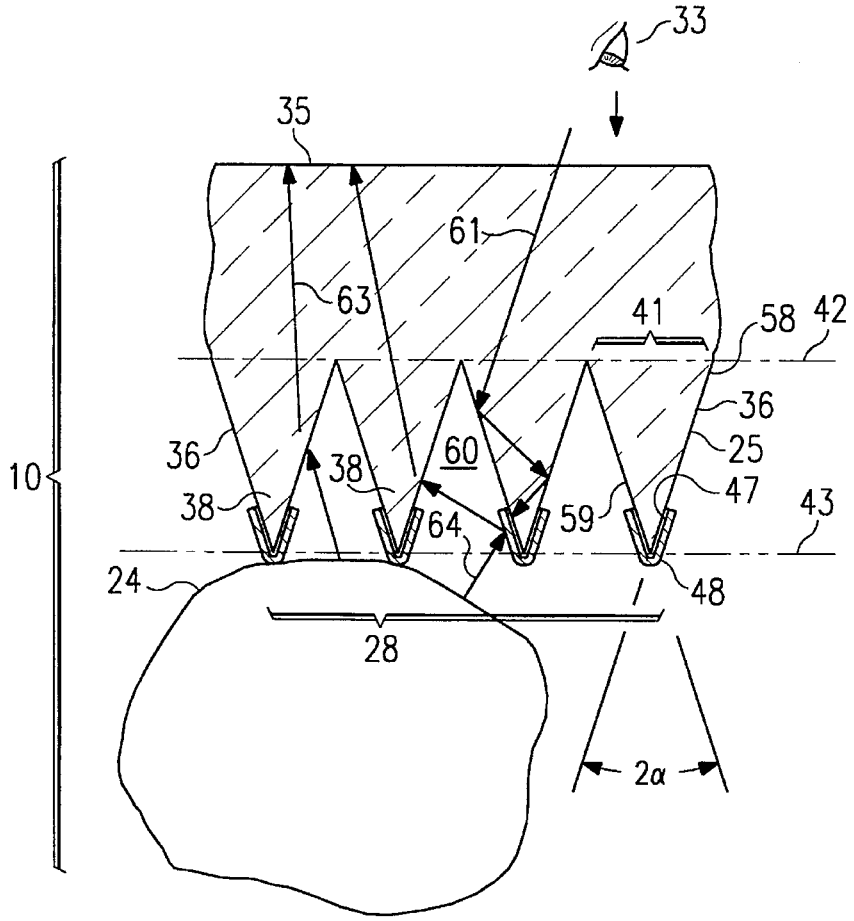
FIG. 2 is an enlarged cross-sectional view of an embodiment of transparent face plate in accordance with the invention, usable in the device of FIG. 1.
Figure 3:
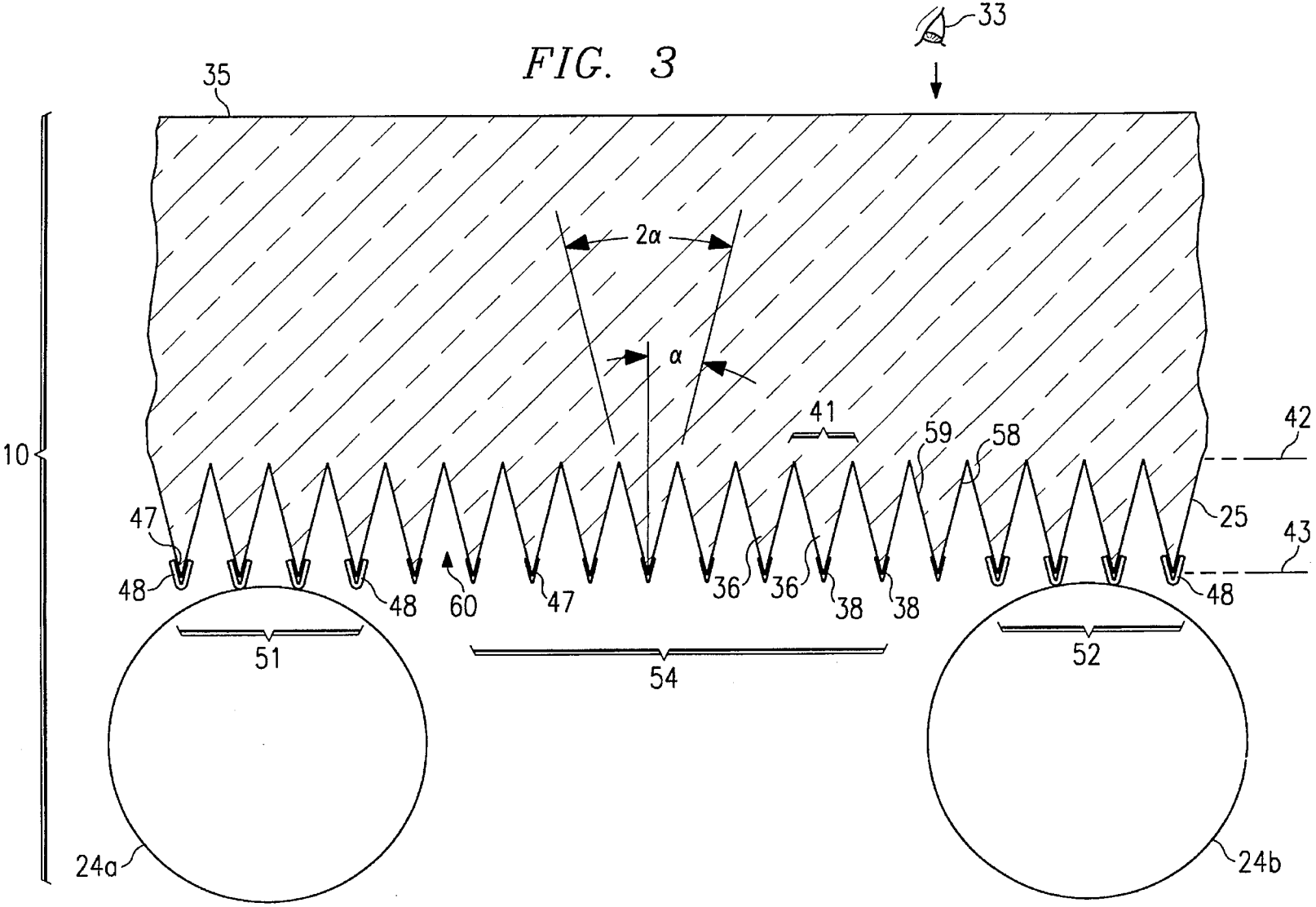
FIG. 3 is a like cross-sectional view of a modified embodiment of the transparent face plate of FIG. 2.
Figure 4:
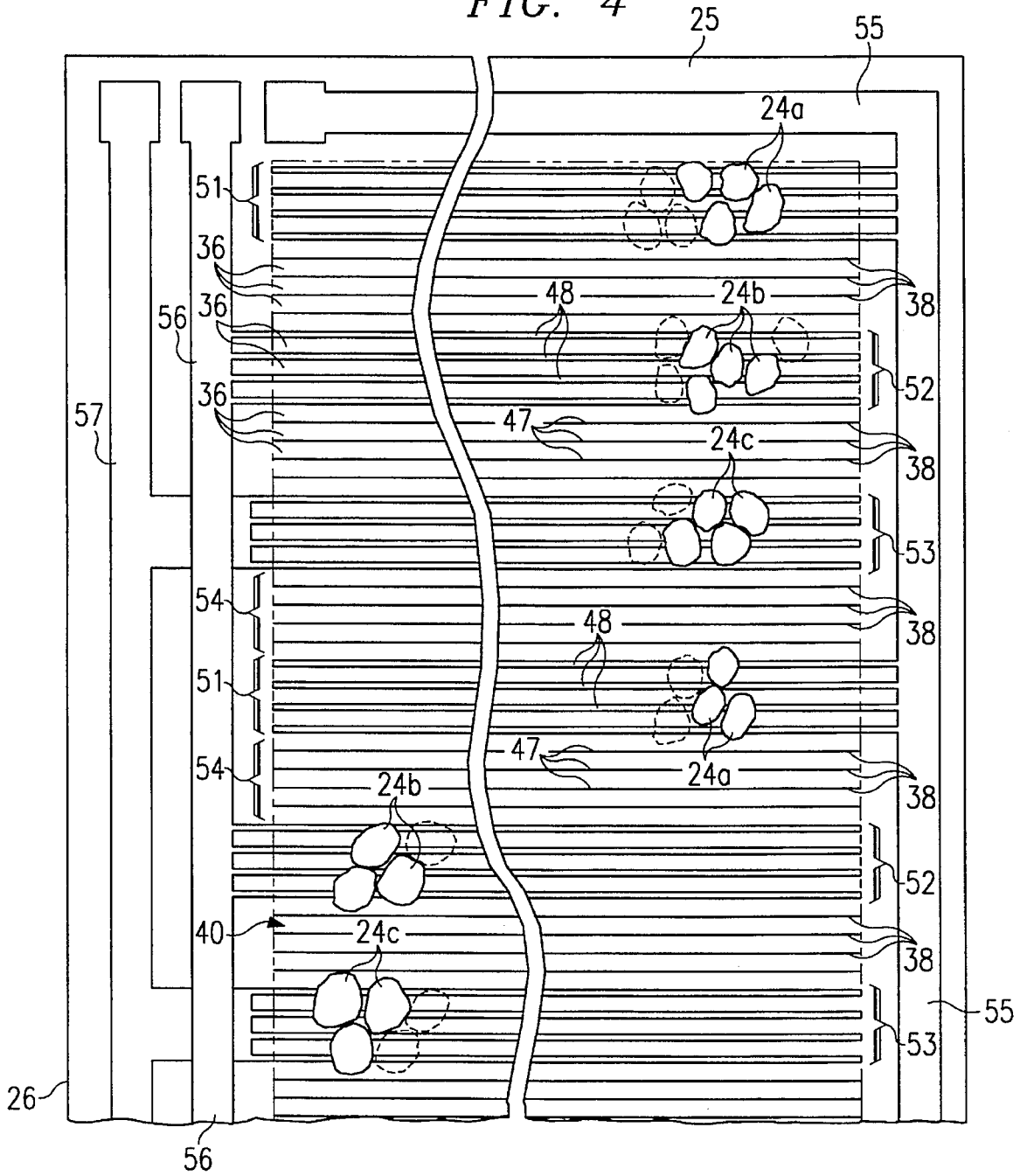
FIG. 4 is a bottom plan view of a face plate as in FIG. 3.

As shown for a single anode electrode embodiment in FIG. 2 and for a multiple anode electrode embodiment in FIGS. 3 and 4, transparent anode plate 10 is configured in accordance with the principles of the invention to have a generally locally planar and smooth forward facing or outside surface 35 and a periodically undulated backward facing or internal surface 25, presenting a side-by-side array of steep-walled triangular prisms 36, having apexes 38 extending in parallel lines, laterally or longitudinally across an active imaging region 40 of the surface 25 (see FIG. 4). The inside surface 25 of plate 10, thus, presents a grating of juxtaposed prisms 36 having bases 41 aligned along an imaginary line 42 generally parallel to outside surface 35, and peaks or apexes 38 aligned along an imaginary line 43 parallel to line 42. Apexes 38 of each prism 36 are coated with a layer of light absorbing material, such as carbon black material 47, and then coated again with a layer of conductive material, such as aluminum 48.

In the FIG. 2 device, suitable for monochrome display, all apexes 38 of all prisms 36 are provided with light absorbing and conductive material 47, 48. The separate aluminum covered portions of the apexes 38 of the different prisms 36 are then commonly connected to form a single anode electrode 28 covering substantially the whole of the internal surface 25 of face plate 10. The phosphorescent coating 24 is then applied over the conductive layer 48, as particles 24 in contact with the electrode 28. Coating 24 can be phosphor particles of relatively uniform composition which luminesce under matrix-addressed excitation of electrodes, upon suitable voltage potential applied to anode 28. If a suitable conductive material is available for use as the light absorber 47, the use of a separate conductor 48 may not be necessary.

For the FIGS. 3 and 4 configuration, which is suitable for color display, all apexes 38 are likewise provided with light absorbing material 47. The conductive material 48 is, however, laid down only in selected areas 51, 52, 53 of grouped juxtaposed prisms 36, separated by intervening areas 54 of other juxtaposed prisms 36 whose apexes 38 are left uncovered by conductive material 48. The different conductive layer groupings 51, 52, 53 are then respectively connected by electrically isolated stripes 55, 56, 57 of the same or different conductive material deposited outside of the active imaging region 40 (FIG. 4), marginally on inside surface 25 of plate 26. The joined groupings 51, 52, 53 thereby form three separately activatable electrode combs, one for each primary color. Different phosphorescent coatings 24*a*, 24*b*, 24*c* which luminesce in different ones of the three primary colors, are then applied to the groupings of each comb, to form the separate red, green and blue color anode bands used for display of a color image.

The illustrated prisms 36 are isosceles prisms, having equal side surfaces 58, 59 converging rearwardly in an inward direction toward plate 12 at angles of convergence $2\alpha$, where $\alpha$ is the half-angle taken with reference to the angle bisector (see FIGS. 2 and 3). In general, the angle bisector will be normal to the plane of the opposite surface 35. Angles $\alpha$ are chosen to provide unidirectional light transmission characteristics, whereby ambient light 61 (FIG. 2) incident on external surface 35 and entering plate 10 from the front will be guided rearwardly through the bases 41 and be trapped by the converging channels of prisms 36 of rear surface 25. Light generated adjacent internal surface 25 by excitation of phosphor particles 24, on the other hand, will be guided forwardly into the conjugate channels of valleys 60 between adjacent prisms 36, and be transmitted forwardly through plate 10, toward the viewer 33. Angles $\alpha$ may be $<30°$, with angles $\alpha$ of 10°–25° being preferred. And, though isosceles construction is recommended, non-isosceles triangular cross-sectional configurations are also possible for the prisms 36.

The saw-toothed grating formed within the imaging region 40 of surface 25 functions so that a majority of the ambient light 61 entering plate 10 through surface 35 (light having incident angles within a range determined based on the refractive indices at the air-glass interface) will strike a side 58, 59 of a prism 36 and be internally reflected. The sharp triangular shape of the prism 36 will promote multiple internal reflections of light 61, rearwardly down toward the prism apex 38, where it will finally be absorbed by the absorbing material 47 at the apex 38. Prisms 36, thus, function as light traps to prevent incident ambient light from reaching and being reflected by the granular phosphor 24. Light 63 emitted by phosphor 24, on the other hand, will enter the higher index of refraction of the glass at prism surfaces 58, 59 and be preferentially directed forwardly to the anode plate front surface 25 and out toward the viewer 33. Any obstruction to the forward transmission by the materials 47, 48 covering the apexes 38, will be outweighed by the increase in illumination due to enhanced forward directivity provided by the forward direction focusing effect of the prisms 36. In a two layered material 47, 48 approach (viz. aluminum coated carbonized tips), absorption of emitted light 63 by material 47 can be prevented by using a non-absorbing non-transparent conductor material 48 which, if shiny, will reflect otherwise unseen rays 64 back into the field of view of viewer 33. The grating surface thus functions as a unidirectional filter to minimize back reflections of ambient light and maximize the light reaching the viewer from the phosphor. Since the incident ambient light is totally absorbed, there is the possibility of having a contrast ratio exceeding 20*x*, even though the phosphor particles are wide and granular.

The steepness of the prisms 36 and the unidirectional filtering phenomenon tend to make the prism coatings 47, 48 unobtrusive to viewer 33. This makes possible the use of more traditional and more conductive light non-transparent metallic materials for the electrode 28, rather than less conductive light transparent materials such as indium-tin-oxide (ITO). Moreover, the corrugated grating surface 25 provides irregular surface terrain with multiple depressions 60 in non-conductive regions 54 between adjacent electrode bands 51, 52, 53 (see FIGS. 3 and 4) of respective red, green and blue anode combs. This increases the surface path between electrodes, thereby decreasing surface leakage and enabling greater anode voltages in multi-electrode designs. Valleys 60 will also protect against stray conductive material 48 which may become deposited unintentionally in regions 54.

The linear grating presented by the prism structure in the glass anode plate 10 can be formed by interference holography techniques, such as those described in Zaidi et al., "Multiple Exposure Interferometric Lithography," SPIE 2197: Optical/Laser Microlithography VII, pp 869–875 (T. A. Brunner, ed. 1994). Such techniques can produce sharp prisms, with peak pitches on the order of 1 micron and prism depths (peak-to-valley line 42, 43 separations) of between 1 and 3 microns, corresponding to half-angles of between 26° and 9°. respectively. For comparison, the phosphor particles are typically 5–10 microns in diameter so that one phosphor particle will reside on one or more prism apexes. Such structure is very corrugated and thus greatly decreases surface conductivity and should allow lateral voltage standoffs of up to 2,000 volts.

One method of forming the plates 10 of FIG. 2 or FIGS. 3 and 4 is illustrated schematically with respect to FIGS. 5A–5E (not to scale).

Figure 5A:
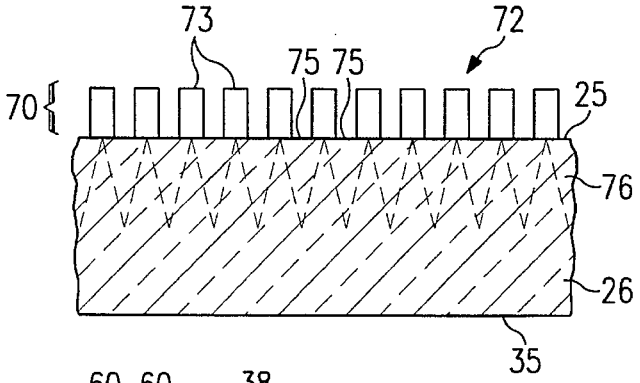
FIGS. 5A–5E are schematic views, showing successive steps in a method of manufacture of the face plate.
Figure 5B:
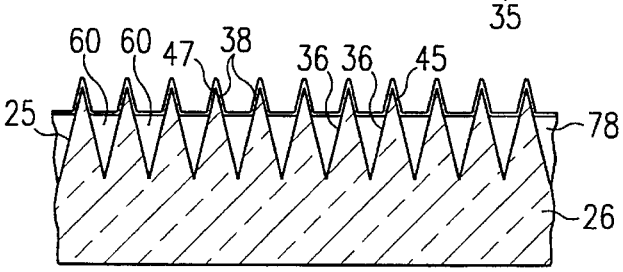

An inside surface 25 of a transparent rectangular glass plate 26 is uniformly coated with a layer of photoresist 70. The photoresist 70 is exposed using interference holography and developed to remove portions of photoresist 70, leaving a grating 72 of longitudinally or laterally extending bands 73 of unremoved portions of photoresist 70, separated by intervening gaps 75, as illustrated in FIG. 5A. One or more additional layers of photoresist (not shown) may be applied in separate masking steps to form the marginal areas away from the active imaging region for the purpose of constructing driver electronics, electrode stripe interconnections, pads, or the like. The plate 26, covered with photoresist grating 72, is then subjected to etching to form a periodically undulated sawtoothed cross-sectional configuration 76 of surface 25 defining juxtaposed prisms 36, as previously described. The separately masked marginal regions of plate 26 are left unetched, to provide a stable platform for driver electronics, interconnections, etc. The material of photoresist layer 70 is chosen so that the etching characteristics of the developed photoresist portions constituting the spaced bands 73 of grating 72 generally match the etching characteristics of glass plate 26. The thickness of layer 70 and spacing between bands 73 is chosen empirically, to provide the desired peak-to-valley depth and half-angle α, discussed above. The interference holography is performed to give a pitch of developed photoresist band 73 equal to the pitch of prism structures desired in the ending contour of surface 25.

Next, another layer of photoresist 78 is spun onto surface 25 to partially fill the V-shaped valleys 60 to approximately ¾ of the valley depths (i.e., to ¾ of the prism base-to-apex height). The layer 78 may also be used to completely or selectively match portions of the marginal regions, as required. A layer of light absorbing carbon material 47 is then deposited by evaporation over surface 25 to cover the exposed tips at the peak apexes 38 of prisms 36. At this point, the active imaging region 40 (see FIG. 4) appears as shown schematically in FIG. 5B (not to scale, with prism and deposition layer dimensions exaggerated relative to thickness of plate 26). For a single anode electrode construction, as described above in reference to FIG. 2, the conductive material layer 48 (viz. aluminum) may now be deposited (viz. sputtered) directly over the carbon layer 47. For the three electrode color display configuration of FIGS. 3 and 4 however, another masking step is first undertaken in order to create the isolation regions 54 between adjacent electrode bands 51, 52, 53 (see FIGS. 3 and 4).

Figure 5C:
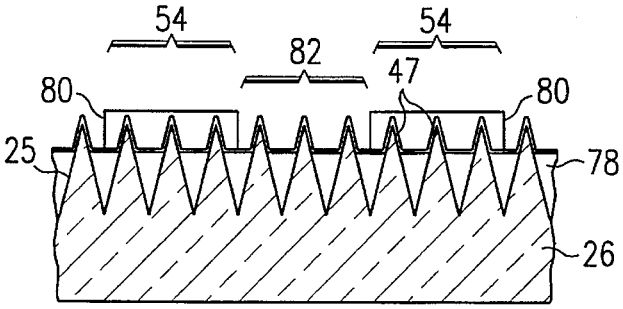

As illustrated in FIG. 5C, another layer of photoresist 80 is deposited onto the surface 25, without removal of the prior photoresist layer 78. Layer 80 is exposed using conventional masking techniques and developed to selectively remove portions, leaving a photoresist covering defining the isolation regions 54. Regions 82 are left uncovered by layer 80 to define the stripes 51, 52, 53 which will constitute the three different color anode electrode combs. Marginal regions are masked in known ways to provide the interconnections 55, 56, 57 (see FIG. 4) among the respective bands of each series.

Figure 5D:
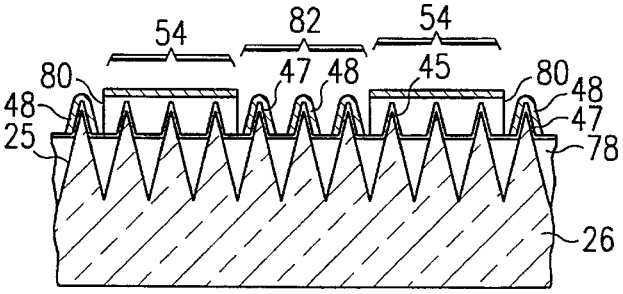
Figure 5E:
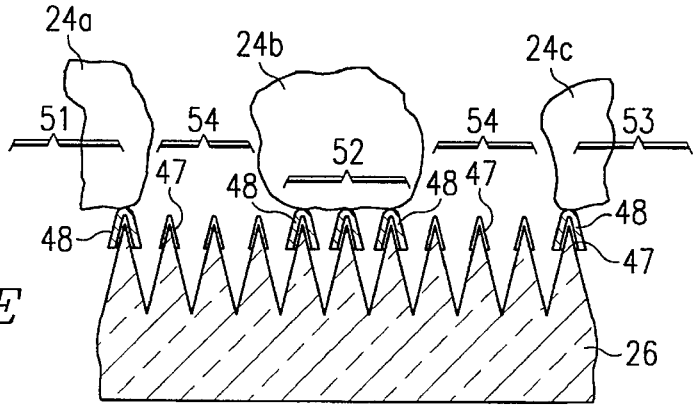

As shown in FIG. 5D, a layer of conductive aluminum 48 is now deposited by sputtering over the surface 25. This results in deposition of conductive material 48 over the carbon material 47 in the regions 82 defining stripes 51, 52, 53 that are not covered by photoresist layer 80. The carbon-covered tips of prisms 36 located in regions 54 covered by layer 80 are shielded from aluminum deposition. Layers of photoresist 78 and 80 are then lifted off by solvent or other known mechanisms, and different colored phosphors 24*a*, 24*b* and 24*c* deposited by electrophoretic deposition onto respective stripes 51, 52 and 53 of the electrode combs. The prisms 36 in regions 54, which were covered by photoresist layer 80, have no conductive material covering their apexes, so serve to electrically isolate electrode stripes 51, 52 and 53 from each other. The final structure is illustrated schematically in FIG. 5E. It will, of course, be appreciated that relative dimensioning of elements has been distorted and numbers of repetitive features have been kept to a minimum for clarity and ease of illustration, and that, in particular, each anode 51, 52, 53 will have a multiplicity of phosphor particles 24*a*, 24*b*, 24*c* and many more prisms 36 will occupy each anode stripe 51, 52, 53 and isolating region 54.

Those skilled in the art to which the invention relates will appreciate that other substitutions and modifications can be made to the described embodiment, without departing from the spirit and scope of the invention as defined by the claims below.

What is claimed is:

1. An anode plate for a cathodoluminescent image display device, said anode plate comprising:

a substrate having an inner surface and an outer, surface said substrate being transparent at least in an imaging region; said inner surface having a surface contour forming a grating of prisms in said imaging region; and said prisms having apexes;

a conductive material covering a plurality of said apexes; said conductive material covering at least two of said apexes being electrically connected to form an anode electrode comb; and a cathodoluminescent material deposited in said imaging region on said anode electrode comb.

2. An anode plate as in claim 1, wherein said conductive material is aluminum and said cathodoluminescent material is phosphor.

3. An anode plate as in claim 1, further comprising a light absorbing material covering said plurality of said apexes; said conductive material being located over said light absorbing material.

4. An anode plate as in claim 3, wherein said light absorbing material also covers a second plurality of said apexes different from said first plurality of apexes.

5. An anode plate as in claim 1, wherein said conductive material is connected to form three electrically isolated anode electrode combs; and wherein said cathodoluminescent material comprises three materials that luminesce at different colors of light respectively deposited on different ones of said anode electrode combs.

6. An anode plate as in claim 5, further comprising a light absorbing material covering said plurality of said apexes; said conductive material being located over said light absorbing material.

7. An anode plate as in claim 6, wherein said light absorbing material also covers apexes of ones of said prisms located between conductive material covered prisms of the separate anode electrode combs.

8. A cathodoluminescent image display device comprising the anode plate of claim 1 in combination with a cathode plate comprising:

a second substrate spaced from said anode plate substrate; and a cathode electrode including a multiplicity of electrically conductive microtips formed on said second substrate; said inner surface of said anode plate facing toward said microtips and said outer surface of said anode plate facing away from said microtips.

9. An anode plate as in claim 8, wherein said second substrate comprises a transparent glass plate; and said cathodoluminescent material is a phosphor coating applied over said conductive material.

10. An anode plate as in claim 9, wherein said prisms comprise isosceles prisms having equal sides converging at angles of convergence in a direction toward said microtips.

11. An anode plate as in claim 10, wherein said prisms have half-angles defined between said sides and a bisector of said angles of convergence, said half-angles being less than 30 degrees.

12. An anode plate as in claim 11, wherein said half-angles are within a range of 15 to 25 degrees.

13. An anode plate for a cathodoluminescent image display device, said anode plate comprising:

a plate having oppositely facing front and rear surfaces; said plate being transparent at least in an imaging region; said rear surface having a surface contour forming a grating of prisms in said imaging region; said prisms having apexes;

a light absorbing material covering a first plurality of said apexes;

a conductive material covering a second plurality of said apexes, said first plurality of apexes including at least said second plurality of apexes; said conductive material covering different ones of said apexes being electrically connected to form an anode electrode comb; and a cathodoluminescent material deposited on said plate over said conductive material.

14. An anode plate as in claim 13, wherein said plate is a glass plate and said cathodoluminescent material is a phosphor material.

15. An anode plate as in claim 14, wherein said prisms are isosceles prisms having equal sides converging at angles of convergence in a direction away from said front surface; said angles of convergence being characterized by half-angles defined between said sides and bisectors of said angles of convergence; said half-angles being less than 30 degrees.

16. An anode plate as in claim 15, wherein said half-angles are within a range of 10 to 25 degrees.

17. An anode plate as in claim 13, wherein said light absorbing material is carbon and said conductive material is aluminum.

18. A light transmitting anode plate comprising:

front and rear surfaces, said rear surface being configured with a grating comprising a side-by-side array of prisms, said prisms having acute-angle apexes; and material deposited on said apexes, said material being light absorbing and electrically conductive, and being connected to form at least one anode electrode comb;

said prisms providing preferential transmission of light in a direction from said rear to said front surface.

19. An anode plate, comprising:

a plate with front and rear surfaces, said rear surface being configured with a grating comprising a side-by-side array of prisms, said prisms having acute-angle apexes;

light absorbing material deposited on said apexes; and electrically conductive material deposited on at least some of said apexes over said light absorbing material, said electrically conductive material being connected to form at least one anode electrode comb;

said prisms blocking transmission of light from said front to said rear surface, and said prisms passing transmission of light from said rear to said front surface.

* * * * *